United States Patent [19]

Pacetti

[11] 4,135,644

[45] Jan. 23, 1979

[54] CAULKING GUN

[76] Inventor: Clarence N. Pacetti, Rte. #1, Box 143, LaSalle, Ill. 61301

[21] Appl. No.: 706,278

[22] Filed: Jul. 19, 1976

[51] Int. Cl.[2] ..... B67B 7/28

[52] U.S. Cl. ..... 222/81; 222/326

[58] Field of Search ..... 222/81, 80, 325–327, 222/82, 541, 530

[56] References Cited

U.S. PATENT DOCUMENTS

| | | | |
|---|---|---|---|
| 2,203,710 | 6/1940 | Young | 222/82 |
| 2,644,608 | 7/1953 | Lee | 222/81 X |
| 2,957,614 | 10/1960 | Krajcovic | 222/530 X |
| 2,961,014 | 11/1960 | Appleton | 222/81 X |
| 3,105,614 | 10/1963 | Sherbondy | 222/82 |
| 3,189,226 | 6/1965 | Sherbondy | 222/82 |
| 3,920,156 | 11/1975 | Hicks | 222/80 |

*Primary Examiner*—Joseph F. Peters, Jr.
*Assistant Examiner*—Norman L. Stack, Jr.

[57] ABSTRACT

A caulking gun is disclosed comprising a handle, a ramp mounted on the handle for receiving a caulking cartridge having a nozzle thereon, the end of which has to be removed by cutting. The nozzle of the caulking gun is also sealed to a caulking cartridge by means of a ruptureable seal. An opening is provided in the handle into which the nozzle of such a caulking gun may be inserted to cut the end therefrom by means of a knife blade operably attached to a trigger used for advancing a ram to extrude caulking compound from the cartridge. The handle of the caulking gun also contains a puncturing tool retractably mounted in the handle for puncturing the seal at the base of the nozzle of the caulking cartridge.

1 Claim, 6 Drawing Figures

FIG.1
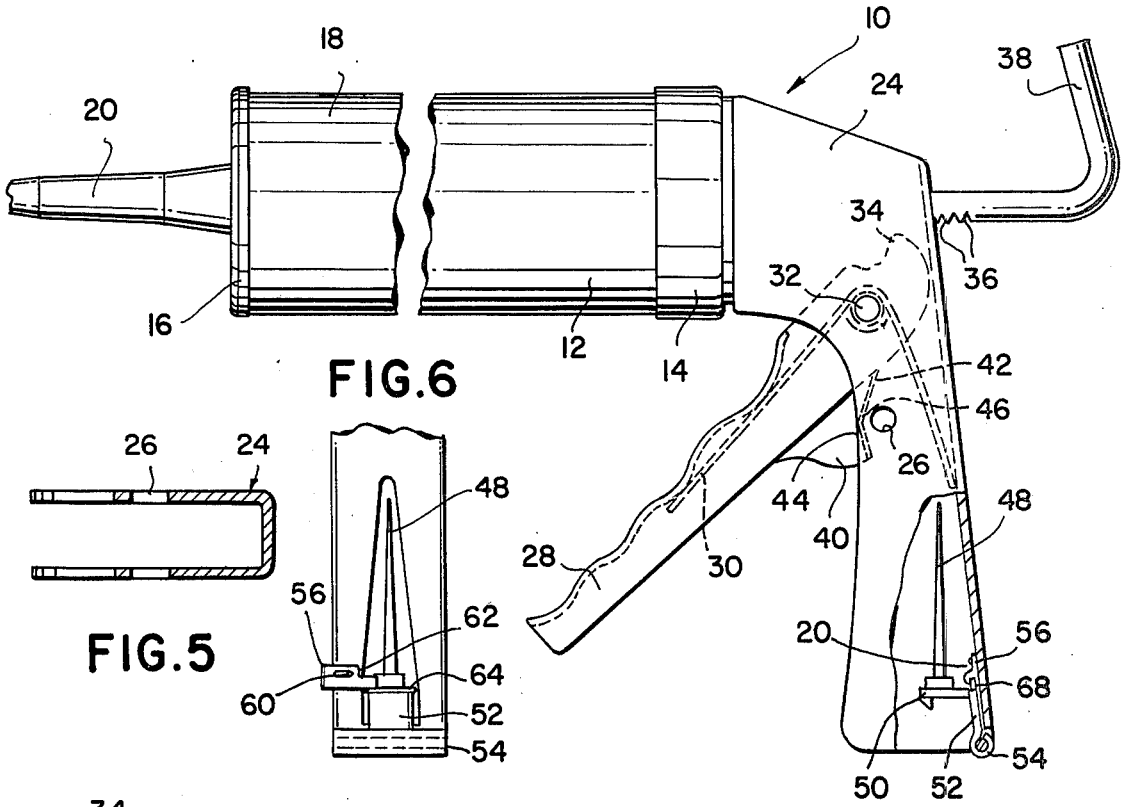
FIG.6
FIG.5
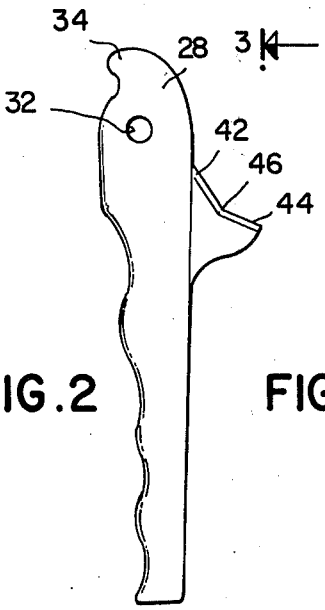
FIG.2
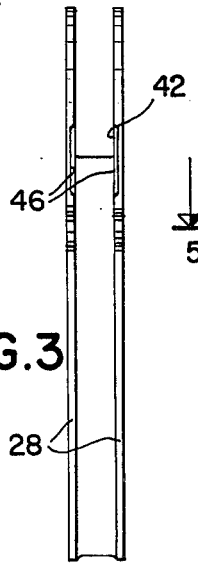
FIG.3
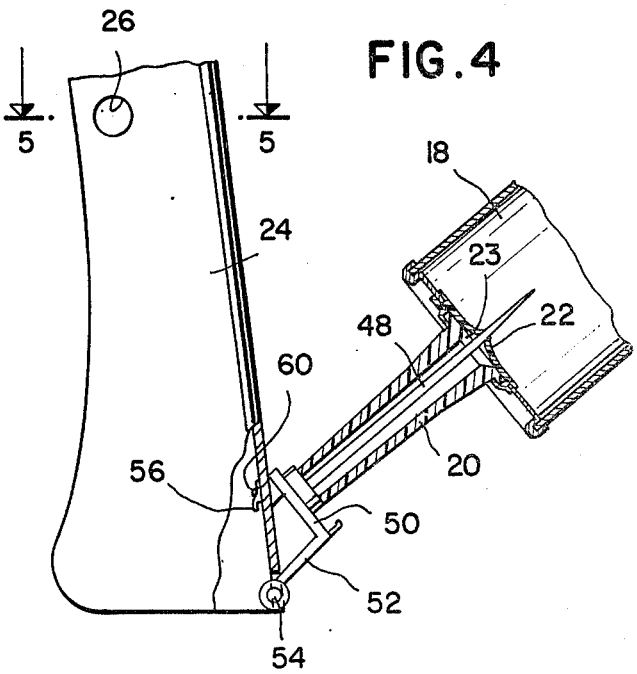
FIG.4

CAULKING GUN

SUMMARY OF THE INVENTION

The present invention relates to a caulking gun comprising a handle, a ramp mounted on the handle, the ramp being adapted for receiving a caulking cartridge with an openable nozzle sealed thereto at the base by means of a rupturable seal. A ram is mounted on the caulking gun for operably engaging a caulking cartridge to dispense caulking compound from the nozzle of the cartridge. A trigger is pivotally attached to the handle for incrementally advancing the ram into operative engagement with the caulking cartridge for dispensing caulking compound. A cutting member is provided on the trigger for operatively engaging an opening in the handle for cutting the end from the nozzle of a caulking gun when the trigger is pivotally moved in the direction for advancing the ram. A puncturing tool is retractably secured to the handle for insertion into the nozzle of a caulking cartridge to break the seal thereof.

In another embodiment, the cutting tool comprises a blade on the trigger, the opening in the handle being in a plane in the handle parallel to the plane of the blade. The trigger is pivotally mounted to swing the blade in a plane parallel to the plane of the opening.

In yet another embodiment, the blade has a first cutting edge and a second cutting edge intersecting at an apex, the apex being pivotable to swing toward the transverse axis of the opening.

In a further embodiment, the puncturing member comprises a spike pivotally secured to the handle on a spike pivot, the spike being pivotally retractable into the handle through an opening in the handle extending from the spike pivot.

In another embodiment, a retaining member is mounted on the handle for releasably holding the spike in a retracted position.

The invention also relates to a caulking gun comprising a handle, a ramp mounted on the handle, the ramp being adapted for receiving a caulking cartridge with an openable nozzle sealed thereto at the base by a rupturable seal. A ram is mounted on the caulking gun for operatively engaging a caulking cartridge to dispense caulking compound from the nozzle thereof. A trigger is pivotally attached to the handle for incrementally advancing the ram into operative engagement with the caulking cartridge. A cutting member is positioned on the trigger for operatively engaging the opening in the handle for cutting the end from a nozzle from the caulking gun when the trigger is pivotally moved in the direction for advancing the ram. The cutting member comprises a blade having a first cutting edge and a second cutting edge intersecting at an apex, the apex being pivotable to swing toward the transverse axis of the opening. In a further embodiment of this aspect of the caulking gun, the cutting member comprises a blade on the trigger, the opening in the handle being in a plane in the handle parallel to the plane of the blade, the trigger being pivotally mounted to swing the blade in a plane parallel to the plane of the opening.

BRIEF DESCRIPTION OF THE SEVERAL VIEWS OF THE DRAWING

FIG. 1 comprises a side elevation partially in section illustrating a caulking gun having a cutting member affixed to the trigger for removing the ends of the nozzle of a caulking cartridge, the caulking gun also having a puncturing member retractably secured to the handle thereof for insertion into a nozzle of a caulking cartridge to break the seal thereof according to one embodiment of the present invention;

FIG. 2 comprises a side elevation of a trigger of a caulking gun and the cutting blade thereon according to one embodiment of the present invention;

FIG. 3 comprises a front elevation of a trigger of a caulking gun, the trigger having a cutting edge thereon according to an embodiment of the invention;

FIG. 4 comprises a side elevation partially in sectin illustrating the use of a puncturing member retractably extended from the handle of the caulking gun and inserted into the noxxle of a caulking cartridge to break the seal thereof according to another embodiment of the present invention;

FIG. 5 comprises a plan view taken along the line 5—5 from FIG. 4;

FIG. 6 comprises a rear elevation partially in section illustrating a puncturing tool retractably secured to the handle of a caulking gun for insertion into a nozzle of a caulking cartridge to break the seal thereof, the puncturing tool being pivotally rotatable into the handle through an opening in the handle extending from the puncturing tool according to yet another embodiment of the present invention.

DETAILED DESCRIPTION

Cartridge type guns are disclosed in the prior art U.S. Pat. Nos. 3,105,614 Sherbondy; 3,189,226 Sherbondy; 2,786,604 Collins; 2,768,768 Cornell, et al.; and, 2,102,939 Bishop.

Both of the Sherbondy references disclose caulking guns with trimming attachments for removing the end of a nozzle of a caulking cartridge employed in conjunction with the caulking gun.

None of the aforementioned references provides a member incorporated into the caulking gun which may be used for rupturing the seal between the nozzle of a caulking cartridge and the cartridge on which it is mounted. This seal may be ruptured by exerting pressure on the caulking composition within the cartridge; however, this procedure puts an undue amount of strain on the mechanism of the caulking gun causing premature breakage of the gun. The better process is to break the seal after the end of a nozzle has been trimmed to provide the right opening by means other than applying pressure on the seal through the caulking gun mechanism. It would also be an advantage to provide a more efficient cutting edge for a smoother operation of the cutting mechanism of such a gun, i.e., a cutting edge or blade that always presents one edge of the blade at an angle to the nozzle which is to be trimmed.

It is therefore an object to obtain these and other objects and overcome these and other difficulties encountered in the prior art.

It is a further object of the present invention to provide a novel caulking gun having a puncturing tool thereon for puncturing the seal at the base of a nozzle of a caulking cartridge once the tip of the nozzle has been trimmed.

It is a further object of the present invention to provide a caulking gun having a knife actuated by the trigger therein for efficiently cutting and removing the tip from the nozzle of a caulking cartridge.

These and other objects have been achieved according to the present invention and will become apparent by reference to the disclosure and claims that follow as well as the appended drawing.

Referring to the drawing, a caulking gun 10 is illustrated comprising a ramp 12 having a cartridge receiving collar 14 at the base thereof and a cartridge retaining disc having a nozzle opening (not illustrated) therein. A cartridge 18 is mounted on the ramp 12, cartridge 18 terminating in a nozzle 20 such as a polyethylene nozzle, the end of which is closed and which has to be clipped prior to use. The ramp 12 is mounted on the handle 24 having an opening 26 into which the nozzle 20 may be inserted. A trigger 28 resiliently biased in a forward position by means of a spring 30 is mounted in the handle 24 on a pivot passing through an opening 32 in the trigger, the pivot being secured to the handle 24. Trigger 28 has a ratchet engaging edge 34 for engaging a plurality of ratchet notches 36 in ram 38, a pawl also being provided (not illustrated) in the handle 24 for engaging notches 36 and allowing the advancement of a ram 38 incrementally towards the cartridge 18 when the trigger 28 is pivotally swung towards the handle 24. A cutting blade 40 extends from the trigger 28, blade 40 having cutting edges 42 and 44 extending from blade 40 and meeting at an apex 46. In one embodiment, the hole or opening 26 extends through the handle 24 and the cutting edges 42 are provided on either side of the trigger along with cutting edges 44 apex 46 being similarly arranged on trigger 28 as illustrated in FIG. 3. A puncturing tool comprising a spike 48 is pivotally mounted on a platform 50 secured to one end of the handle 24 by means of a hinge 52 pivotally mounted on a pin 54 secured to the base of handle 24. Spike 48 can pivot through an opening 58 in the handle 24 to a position as illustrated in FIG. 4 for puncturing the seals 22 and 23 at the base of a nozzle 20 extending from cartridge 18. Spike 48 is secured in a retracted position in handle 24 by means of a slide 56 having a lip thereover for engaging a flange 64 on platform 50. Slide 56 is secured to handle 24 by means of a rivet 60 mounted through a slot opening 62 on slide 56.

In use, a caulking cartridge 18 is inserted either into the left hand or right hand side of the opening 26 and trigger 28 pivoted to remove the portion of the end of the nozzle 20. In a preferred embodiment nozzle 20 comprises a thermoplastic nozzle such as polyethylene, polypropylene and the art known equivalents thereof. A flexible seal 22 is positioned at the base of nozzle 20 along with seal 23 which has to be punctured prior to using the cartridge 18 this being accomplished by removing the slide 56 laterally away from the opening 58 to disengage the lip thereof from flange 64 and to swing the spike 48 outward from the opening 58 as illustrated in FIG. 4. The spike 48 is then inserted into the nozzle 20 to puncture seals 22 and 23 after which the cartridge 18 is positioned in the ramp 12 and ram 38 activated incrementally by pivoting trigger 28 towards handle 24. The positioning of the cutting edges 42 and 44 to meet at an apex 46 is especially useful in providing an efficient cutting tool for removing the tip of nozzle 20. These cutting edges are positioned so that they may be pivotally swung to substantially move toward the transverse axis of the opening 26 thus always presenting one of the cutting edges 44 or 46 at an angle to the edge of the nozzle 20 inserted in the opening 26 thereby assuring an extra mechanical advantage in cttting and removing the tip of nozzle 20.

Although the invention has been described by to some embodiments, it is not intended that the novel caulking gun be limteed thereby but that modifications thereof are intended to be included as falling within the broad spirit and scope of the foregoing disclosure, the following claims and the appended drawing.

What is claimed is:

1. A caulking gun comprising a handle, a ramp mounted on said handle, said ramp being adapted for receiving a caulking cartridge having an openable nozzle sealed thereto at the base by a ruptureable seal, a ram mounted on said caulking gun for operatively engaging a caulking cartridge to dispense caulking compound from the nozzle of such cartridge, trigger means pivotally attached to said handle for incrementally advancing said ram into operative engagement with a caulking cartridge, cutting means on said trigger operatively engaging an opening in said handle for cutting the end from a nozzle of a caulking cartridge inserted in said opening when said trigger is pivotally moved in a direction for advancing said ram, said cutting means comprising a planar blade on said trigger, said opening in said handle being in a plane in said handle parallel to the plane of said blade, said trigger being pivotally mounted to swing said blade in a plane parallel to the plane of said opening, said blade having a first cutting edge and a second cutting edge intersecting at an apex, said apex being pivotable to move toward the transverse axis of said opening, puncturing means retractably secured to said handle for insertion into a nozzle of a caulking cartridge to break the seal at the base of such nozzle, said puncturing means comprising a spike pivotally secured to said handle on a spike pivot means, said spike being pivotally retractable into said handle through an opening in said handle extending from said spike pivot means, and retaining means mounted on said handle for releasably holding said puncturing means in a retracted position.

* * * * *